US008760462B2

(12) United States Patent
Chong et al.

(10) Patent No.: US 8,760,462 B2
(45) Date of Patent: Jun. 24, 2014

(54) COLOR MANAGEMENT METHOD FOR COLOR REPRESENTATION WITH SELF-LUMINOUS COLOR PRIMARIES

(75) Inventors: Patrick Tak Fu Chong, Mount Arlington, NJ (US); Hugh Fairman, Stillwater, NJ (US)

(73) Assignee: Columbia Insurance Company, Omaha, NE (US)

( * ) Notice: Subject to any disclaimer, the term of this patent is extended or adjusted under 35 U.S.C. 154(b) by 1009 days.

(21) Appl. No.: 12/775,181

(22) Filed: May 6, 2010

(65) Prior Publication Data

US 2011/0273468 A1 Nov. 10, 2011

(51) Int. Cl.
*G09G 5/02* (2006.01)
*B44D 3/00* (2006.01)

(52) U.S. Cl.
CPC ..... *B44D 3/003* (2013.01)
USPC ..... 345/593; 345/589; 345/643

(58) Field of Classification Search
CPC ..... G09G 2340/10; G09G 5/026; G09G 2300/0828; G09G 3/05
See application file for complete search history.

(56) References Cited

U.S. PATENT DOCUMENTS

| | | | |
|---|---|---|---|
| 3,612,753 | A | 10/1971 | Korman |
| 4,500,919 | A | 2/1985 | Schreiber |
| 5,608,213 | A | 3/1997 | Pinkus et al. |
| 5,670,985 | A | 9/1997 | Cappels et al. |
| 6,204,940 | B1 | 3/2001 | Lin et al. |
| 6,259,430 | B1 | 7/2001 | Riddle et al. |
| 6,307,490 | B1 | 10/2001 | Litfin et al. |
| 6,686,953 | B1 | 2/2004 | Holmes |
| 6,698,860 | B2 | 3/2004 | Berns et al. |
| 6,714,924 | B1 | 3/2004 | McClanahan |
| 6,985,163 | B2 | 1/2006 | Riddle et al. |
| 7,006,688 | B2 | 2/2006 | Zaklika et al. |
| 2003/0189716 | A1 | 10/2003 | Tsuji et al. |
| 2004/0188594 | A1 | 9/2004 | Brown et al. |
| 2005/0151965 | A1 | 7/2005 | Bissett et al. |
| 2008/0094005 | A1 | 4/2008 | Rabiner et al. |
| 2008/0224025 | A1 | 9/2008 | Lyons et al. |
| 2009/0059322 | A1 | 3/2009 | Vanduyn et al. |
| 2009/0079360 | A1 | 3/2009 | Shteynberg et al. |

OTHER PUBLICATIONS

FRYC and BROWN "LED-Based Spectrally Tunable Source for Radiometric, Photometric, and Colormetric Applications." Optical Engineering, Nov. 2005. vol. 44(11). pp. 1-8.

(Continued)

*Primary Examiner* — Antonio A Caschera
(74) *Attorney, Agent, or Firm* — The H.T. Than Law Group

(57) ABSTRACT

The present invention relates to a unique color management method for calibrating and characterizing a light mixing system comprising a set of primary light modules emitting self-luminous color primaries, which may be intimately mixed to produce a batch color that matches a standard color. The radiant output of each self-luminous color primary, or channel, is modulated by a setting a light controller to a Digital-to-Analog-Conversion ("DAC") value. In the event that the radiant output of the color primary channels is non-linearly proportioned to the DAC input values, it is useful to employ an innovative "iterative best-fit" method of simultaneously calculating admixtures of light from all color primaries that match a standard color. Otherwise, a matrix method based on matrix algebra may also be used to create a batch color that matches a standard color. A best fit tristimulus value method or best fit minimum RMSD can be used in conjunction with these spectral color matching methods. In addition, an optical feedback method may be used to correct systematic drift of the individual color primary channels.

9 Claims, 12 Drawing Sheets

(56) References Cited

OTHER PUBLICATIONS

International Search Report and Written Opinion issued in connection with corresponding International Patent Application No. PCT/US2011/031401 on Jun. 20, 2011.

Berns, Roy S. "Appendix: Mathematics of Color Technology". Principles of Color Technology. Billmeyer and Saltzman's. Third Edition. Rochester Institute of Technology. pp. 203, 208, and 212.

"On the Use of Linear Transformations for Scanner Calibrations". Color Research and Application. pp. 218-219. vol. 18, No. 3. Jun. 1993.

| Wavelength | Red | Yellow | Green | Cyan | Blue | Indigo |
|---|---|---|---|---|---|---|
| **360** | 0.0000 | 0.0000 | 0.0000 | 0.0000 | 0.0000 | 0.0000 |
| **370** | 0.0000 | 0.0000 | 0.0000 | 0.0000 | 0.0000 | 0.0000 |
| **380** | 0.0000 | 0.0000 | 0.0000 | 0.0000 | 0.0000 | 0.0000 |
| **390** | 0.0007 | 0.0009 | 0.0008 | 0.0004 | 0.0006 | 0.0004 |
| **400** | 0.0005 | 0.0006 | 0.0004 | 0.0002 | 0.0001 | 0.0004 |
| **410** | 0.0004 | 0.0003 | 0.0002 | 0.0002 | -0.0001 | 0.0015 |
| **420** | 0.0002 | 0.0003 | 0.0004 | 0.0006 | 0.0038 | 0.0492 |
| **430** | 0.0001 | 0.0003 | 0.0007 | 0.0024 | 0.0514 | 0.3478 |
| **440** | 0.0001 | 0.0003 | 0.0032 | 0.0114 | 0.2613 | 1.1171 |
| **450** | 0.0001 | 0.0002 | 0.0102 | 0.0402 | 0.9276 | 1.3263 |
| **460** | 0.0001 | 0.0004 | 0.0474 | 0.1844 | 2.6635 | 0.7762 |
| **470** | 0.0001 | 0.0004 | 0.1839 | 0.6661 | 2.9762 | 0.3682 |
| **480** | 0.0002 | 0.0003 | 0.5121 | 1.7168 | 1.5095 | 0.1333 |
| **490** | 0.0002 | 0.0002 | 1.1773 | 3.0982 | 0.6062 | 0.0492 |
| **500** | 0.0003 | 0.0001 | 2.3860 | 3.2585 | 0.2319 | 0.0200 |
| **510** | 0.0005 | 0.0003 | 3.9034 | 2.0313 | 0.0868 | 0.0097 |
| **520** | 0.0008 | 0.0002 | 4.5642 | 1.0721 | 0.0369 | 0.0063 |
| **530** | 0.0011 | 0.0003 | 4.0118 | 0.4891 | 0.0159 | 0.0047 |
| **540** | 0.0014 | 0.0005 | 2.7273 | 0.2379 | 0.0095 | 0.0049 |
| **550** | 0.0020 | 0.0036 | 1.5769 | 0.1118 | 0.0062 | 0.0048 |
| **560** | 0.0038 | 0.0320 | 0.7852 | 0.0490 | 0.0047 | 0.0037 |
| **570** | 0.0085 | 0.1911 | 0.4201 | 0.0266 | 0.0043 | 0.0038 |
| **580** | 0.0227 | 1.0679 | 0.2344 | 0.0165 | 0.0041 | 0.0040 |
| **590** | 0.0883 | 3.4758 | 0.1219 | 0.0106 | 0.0038 | 0.0037 |
| **600** | 0.2827 | 7.6330 | 0.0637 | 0.0074 | 0.0033 | 0.0032 |
| **610** | 0.7560 | 5.2604 | 0.0353 | 0.0058 | 0.0029 | 0.0032 |
| **620** | 1.9338 | 1.1253 | 0.0213 | 0.0048 | 0.0025 | 0.0027 |
| **630** | 4.5505 | 0.2916 | 0.0143 | 0.0040 | 0.0021 | 0.0024 |
| **640** | 9.4675 | 0.0655 | 0.0102 | 0.0033 | 0.0018 | 0.0021 |
| **650** | 8.9270 | 0.0203 | 0.0080 | 0.0027 | 0.0015 | 0.0020 |
| **660** | 2.4604 | 0.0247 | 0.0098 | 0.0032 | 0.0014 | 0.0019 |
| **670** | 0.4408 | 0.0205 | 0.0090 | 0.0031 | 0.0012 | 0.0019 |
| **680** | 0.1476 | 0.0174 | 0.0082 | 0.0029 | 0.0012 | 0.0019 |
| **690** | 0.0578 | 0.0158 | 0.0080 | 0.0027 | 0.0011 | 0.0019 |
| **700** | 0.0362 | 0.0144 | 0.0075 | 0.0027 | 0.0011 | 0.0021 |
| **710** | 0.0305 | 0.0130 | 0.0069 | 0.0024 | 0.0010 | 0.0022 |
| **720** | 0.0269 | 0.0119 | 0.0065 | 0.0023 | 0.0009 | 0.0022 |
| **730** | 0.0265 | 0.0122 | 0.0062 | 0.0023 | 0.0009 | 0.0025 |
| **740** | 0.0282 | 0.0123 | 0.0056 | 0.0023 | 0.0009 | 0.0027 |
| **750** | 0.0296 | 0.0137 | 0.0059 | 0.0020 | 0.0007 | 0.0031 |
| **760** | 0.0328 | 0.0140 | 0.0061 | 0.0023 | 0.0008 | 0.0034 |
| **770** | 0.0416 | 0.0176 | 0.0066 | 0.0022 | 0.0009 | 0.0041 |
| **780** | 0.0005 | 0.0001 | 0.0001 | 0.0000 | 0.0000 | 0.0000 |

FIG. 4A

COLOR MANAGEMENT METHOD FOR COLOR REPRESENTATION WITH SELF-LUMINOUS COLOR PRIMARIES

FIELD OF THE INVENTION

This invention generally relates to a method for representing colors with an integrating light capsule that can optically mix multiple color stimuli.

BACKGROUND OF THE INVENTION

Before purchasing paints, buyers typically are given a fan deck or palette comprising hundreds or thousands of paint chips, which represent a small portion of the available paint colors. The paint chips typically measure about 1¼ inch by 2 inches, and recently, the buyers can purchase larger paint chips of about 12 inches by 12 inches to assist the buyers with the mental projection of the colors to the walls. Additionally, the buyers may purchase small containers of about 2 ounces of the desired paints to paint larger swatches on the walls. Typically, the buyers start with small paint chips to narrow the choices and then move to larger paint chips and/or sample paints before choosing the final paint colors.

Recently, paint viewing or paint selection software, such as Benjamin Moore® Paints' Personal Color Viewer™ ("PCV") available either on the World Wide Web or as CD-ROM, has improved the paint selection process for the buyers. The PCV software displays on a computer screen a number of standard interior rooms with furniture, e.g., living room, dining room, bedrooms kitchen and bathroom, as well as the exteriors of a dwelling. The buyers can change the colors of the room, including ceiling, trim and upper and lower walls, at will to project the colors to the entire room. Additionally, digital images of the buyers' own dwellings can be manipulated by the PCV software to display the desired colors.

One possible drawback of the paint selection software is that the images are typically displayed on computer screens, which are limited to combinations of three RGB primary colors (red, green and blue), or four CMYK primary colors (cyan, magenta, yellow and black) for printers. Only a limited number of colors can be displayed and viewed when only three or four primary colors are used. Similarly, a fan deck can only display several thousands of colors, while more than ten thousand paint colors are available.

Furthermore, both paint selection software and physical color chip fan deck cannot control the ambient light when paint colors are viewed by the consumers. It is known that colors can look different under different ambient illuminations, i.e., to a consumer a particular color can look one way under one ambient light and look differently under a different ambient light. This phenomenon is known as "color inconstancy." Color inconstancy is the change in color of a single physical color under different lights. For example, the colors we see outdoors are illuminated by the sun with a wide range of color temperature from sunrise to sunset. Indoor illumination or artificial light is rarely as bright as natural sunlight. Illumination is an important factor in viewing colors and the intensity of the environment has a measurable effect on colors viewed by people. This effect explains why a consumer sometimes thinks that a new paint applied at home looks different than that paint had looked at the store.

Another drawback of paint selection software and color chip fan deck is that they may be subject to "source metamerism." Two or more paints may have the same color appearance under one ambient lighting condition, but may appear to be different color under another ambient lighting condition. This is caused by the fact that color pigment combinations of the paints can be different from each other. Paint selection software and color chip fan decks do not have the ability to vary ambient lighting condition.

The patent and scientific literatures disclose a number of attempts to address the representation of colors. A computer screen based color display system is disclosed in U.S. Pat. No. 6,717,584 B2. This reference discloses a method and apparatus for visualizing virtual paints on a computer-generated automobile. Reflectivity of the paints, which is caused by metal flakes or special effect pigments in the paints, and the angle at which the automobile is viewed affect the display of the virtual paints on the computer screen.

The walls in some public buildings, such as airports, have the capability of changing colors due to the lights that are projected on to them. For example, some of the walls in the Detroit airport are illuminated by LEDs. The colors and patterns on these walls can be changed at will by altering the outputs of the LEDs. No attempt is made to match the displayed color to the color of a real object or device independent color, and uniformity of colors on the walls is not a concern.

Methods of representing colors by devices are also described in U.S. Pat. Nos. 6,259,430, 6,985,163, 7,161,311, 7,186,003 and 7,161,313. The '430 patent discloses a method of displaying colors that allegedly can control the metameric effect. This method divides the radiation spectrum into at least four wavelength bands and selects a single representative wavelength in each band. The intensity of each representative wavelength is selected, and a plurality of radiation beams at the selected intensities and representative wavelengths are generated and combined to produce the desired color. The '163 patent discloses a color display method and apparatus for displaying a mixed color produced by mixing a plurality of individual colorants in a predetermined ratio. The '311 patent discloses devices such as light fixtures that combine multiple light emitting diodes (LEDs) to form a light source. The '311 patent discusses using a hollow cylindrical section to help mix the lights emitting from the LEDs. Similarly, researchers at the National Institute of Standards and Technology have used a hollow sphere to mix lights from a number of LED heads that are directly connected to the sphere. See "LED-based Spectrally Tunable Source for Radiometric, Photometric and Colorimetric Applications," I. Fryc, S. Brown, G. Eppeldauer and Y. Ohno, *Optical Engineering* 44(11), 111309 (November 2005) and "Spectral Matching with an LED-based Spectrally Tunable Light Source," I. Fryc, S. Brown and Y. Ohno, *Proc. of SPIE* 5941, 594111 (2005) (hereinafter "the Fryc publications"). The '003 and '313 patents discuss using processor-controlled LEDs with diffusing materials; e.g., transparent, translucent or semi-transparent materials, to produce color-changing effects.

U.S. Pat. Appl. Pub. No. 2006-0155519 A1 (hereinafter the '519 application) discloses a full-size room that can uniformly display machine-generated colors on its walls to allow customers to view paint colors on full-size walls. The machine-generated colors are mixed in diffusers before illuminating the full-size walls. The disclosure of the '519 application is incorporated herein by reference in its entirety.

However, there remains a need in the art for a color management method that may accurately match a batch color, represented by a light mixing system, to a standard color.

SUMMARY OF THE INVENTION

One aspect of the present invention is directed to a method of operating a color mixing apparatus. This inventive method comprising the steps of (a) providing a plurality of primary color channels, wherein the radiant output of each channel is modulated by a digital-to-analog (DAC) value, (b) selecting a plurality of equally spaced, linear values (LIN) from a black point to a WHITE point, (c) selecting a first non-linear mathematical expression that relates the DAC values to the LIN values, (d) setting the DAC values of each primary color channel so that the combined outputs of the primary color channels are achromatic for each LIN value, (e) solving for a variable in the first non-linear mathematical expression to define the relationship between DAC and LIN values for each primary color channel, and (f) calibrating the color mixing apparatus. Alternatively, the linear LIN values can be non-equally spaced.

In one embodiment, the first non-linear mathematical expression comprises an exponential equation. Preferably, the first non-linear mathematical expression is $$DAC=LOW+LEN*LIN^{GAMMA}$$

wherein LOW is a lowest DAC setting for each primary channel that would produce visible light, wherein LEN is a length of between LOW and WHITE, wherein WHITE is a DAC level of each primary channel where a mixture of a combination of all WHITE values of all primary color channels produce a standard white color. The LIN value at the black DAC point is 0.0 and the LIN value at the WHITE point is 1.0.

When the non-linear equation is the exponential equation listed above, the variable in step (e) is GAMMA. In a preferred embodiment, an iterative calculation is used to ascertain the variable GAMMA. A preferred way to ascertain GAMMA comprises the following steps: (e.1) estimating GAMMA, (e.2) calculating the DAC values using the first non-linear equation with the estimated GAMMA, (e.3) displaying a mixture of a combination of all primary color channels using said DAC values and (e.4) repeating steps (e.1)-(e.3) until the mixture of the combination of all primary color channels is achromatic. Steps (e.1)-(e.4) are performed for each LIN value.

The inventive method may further comprise the step of (g) selecting a second non-linear mathematical expression that relates the LIN values to the peak radiance (RAD) for each primary channel. In a preferred embodiment the second non-linear mathematical expression comprises a polynomial equation. A polynomial equation is prepared for each channel and coefficients for the polynomials are ascertained. A preferred polynomial equation is $$LIN=a_0+a_1RAD+a_2RAD^2+a_3RAD^3$$

and the coefficients comprise $a_0$, $a_1$, $a_2$ and $a_3$.

Another aspect of the present invention comprises a step of correcting a systematic drift of at least one primary color channel, which includes correcting the LIN and DAC values. A preferred correction method comprises the steps of (h.1) measuring the RAD value of said at least one primary color channel, (h.2) obtaining an optical feedback value of $LIN_{OF}$ using the second non-linear equation, (h.3) obtaining an established standard $LIN_{GS}$ from step (f), (h.4) obtaining a corrected $LIN_C$ through a first linear equation, and (h.5) obtaining a corrected $DAC_C$ through the first non-linear equation using the corrected $LIN_C$.

An exemplary first linear equation in step (h.4) comprises $$LIN_C=LIN_{GS}+(LIN_{GS}-LIN_{OF}).$$

The inventive color mixing method may further comprise the step of (i) predicting a gain of each primary color channel that would create a batch color matching a standard color. This gain comprises a scalar real number between 0.0 and 1.0 and is a multiplier to the peak radiance (RAD) for each primary color channel.

In a preferred embodiment step (i) comprises the step of (i.1) using an iterative best fit method. The iterative best fit method may comprise the steps of (i.1.1) using a CPU system to adjust the gain for each color primary incrementally, decrementally or serially, (i.1.2) using the CPU system to determine whether there has been an improvement in an index of best fit, and (i.1.3) repeating steps (i.1.1) and (i.1.2) until there is no improvement in the index of best fit. The index of best fit in step (i.1.2) can be a root mean square difference (RMSD) between the radiances of a standard color spectrum and the batch color spectrum.

The inventive color mixing method comprises the steps of (j) converting the gains from step (i) to RAD values for each primary color channel, (k) converting the RAD values from step (j) to LIN values using the second non-linear mathematical expression, (l) converting the LIN values from step (k) to DAC values using the first non-linear mathematical expression, and (m) displaying the batch color on the color mixing system by setting the primary channels to the DAC values from step (l).

In a preferred embodiment, a best fit tristimulus method is conducted after step (i).

In accordance with another aspect of the present invention linear mathematical equations are selected that can relate the DAC values to the LIN values, which can be solved by linear algebra.

BRIEF DESCRIPTION OF THE DRAWINGS

In the accompanying drawings, which form a part of the specification and are to be read in conjunction therewith and in which like reference numerals are used to indicate like parts in the various views:

FIG. 4A is a table representing spectral radiance data of a calibrated light mixing system.

DETAILED DESCRIPTION OF THE PREFERRED EMBODIMENTS

The present invention relates to a unique color management method for calibrating and characterizing a light mixing system comprising a set of primary light modules emitting self-luminous color primaries, which may be intimately mixed to produce a batch color that matches a standard color during calibration, and a batch color that matches a color that the user/consumer wants to match. The radiant output of each self-luminous color primary, or channel, is modulated by setting a light controller to a Digital-to-Analog-Conversion ("DAC") value. Because the radiant output of the color primary channels is non-linearly proportioned to the DAC input values, it is innovative to employ a novel "iterative best-fit" method of simultaneously calculating admixtures of light from all color primaries that match a desired color, as described below. Other methods, including a matrix method based on linear algebra, may also be used to create a batch color that matches a desired color. In addition, since the light sources, such as light emitting diodes, can drift due to temperature fluctuations or long usage, an optical feedback correction method may be used to correct systematic drift of the individual color primary channels.

As used herein, a standard color is the precise color intended and a color desired to be matched by a consumer/user. A batch color preferably embodies at least a satisfactory but not necessarily exact representation of the color intended. The term "satisfactory representation" refers to a "match" of the standard color or the matched color visually, instrumentally, or both according to established criteria such as the criteria stated herein.

Figure 1:
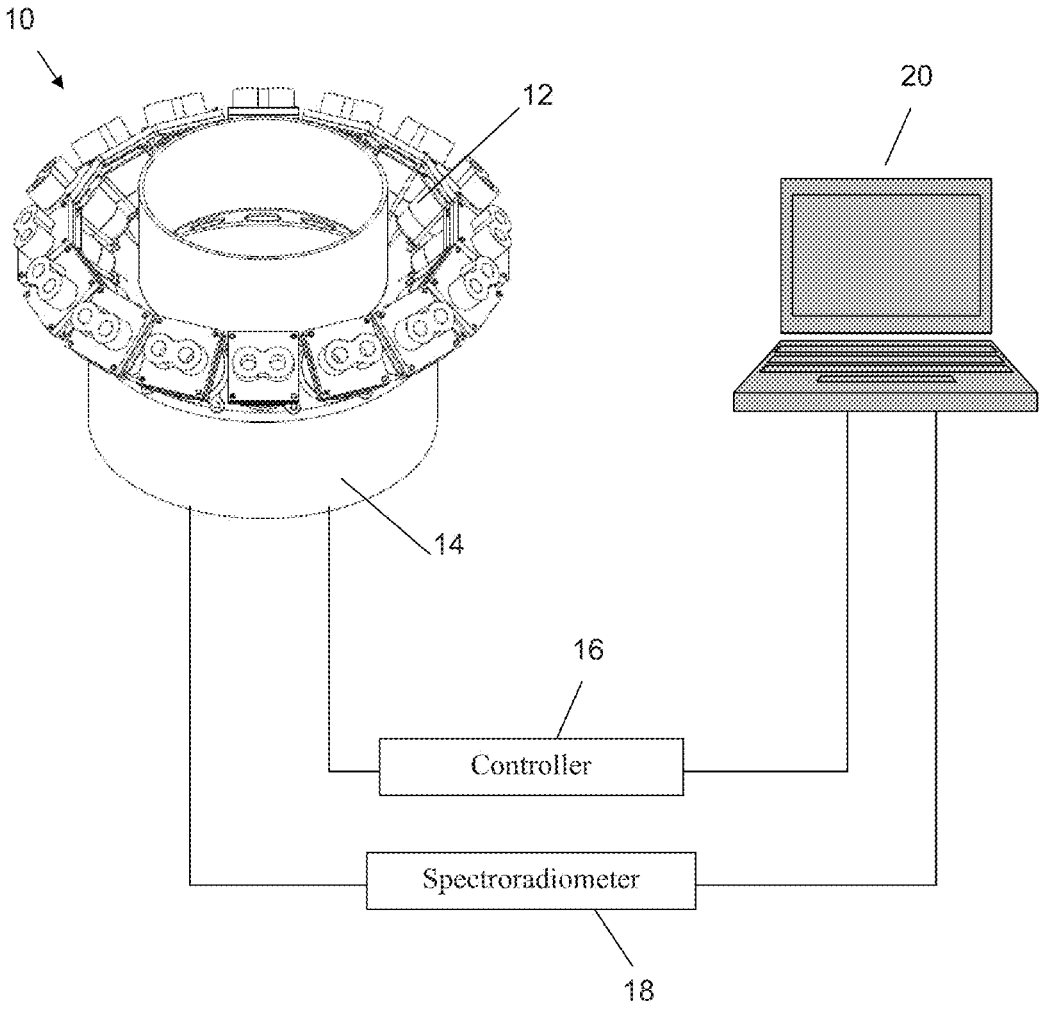
FIG. 1 is a schematic diagram showing a light mixing system and devices connected thereto according to an embodiment of the present invention.

FIG. 1 illustrates an exemplary light mixing system 10 comprising a plurality of primary light modules 12 that are positioned radially around an integrating light mixing chamber 14. Primary light modules 12 may comprise any suitable number of self-luminous color primaries, e.g., at least about 6, preferably at least about 13, more preferably at least about 16 and most preferably at least about 32 color primary channels. The present invention is not limited to any particular number of color primaries. Primary light modules 12 may be constructed using any suitable light source including, but not limited to, light emitting diodes ("LEDs," e.g., narrowband LEDs, broadband LEDs, or white LEDs) and conventional light sources (e.g., fluorescent, incandescent, and halogen light sources). Further discussion of light mixing system 10 and its associated features may be found in the application, i.e., International Patent Application No. PCT/US08/088011, which is incorporated herein in its entirety.

Light mixing chamber 14 facilitates intimate, additive mixing of color primaries emitted by primary light modules 12. The radiance of each color primary channel is managed with a light controller 16 set to a particular DAC setting in a given dynamic range, e.g., between 0 and 255 DAC settings where 255 creates the brightest light in each channel for an 8-bit binary system, i.e., $2^8=256$. A 16-bit, 32-bit, 64-bit, or any n-bit DAC can also be used. A DAC setting allows light controller 16 to convert a digital signal (e.g., binary code) to an analog waveform (e.g., voltage) that produces a radiant output for each primary channel. The spectral radiance of each color primary channel, or group of channels, is measured by a spectroradiometer 18 such as the Minolta CS1000 (commercially available from Konica Minolta Sensing Inc. of Tokyo, Japan) at periodic intervals (e.g., 1-nm and 10-nm intervals). A computer or central processing unit (collectively "CPU") 20 can manage light controller 16 and spectroradiometer 18.

Figure 2:
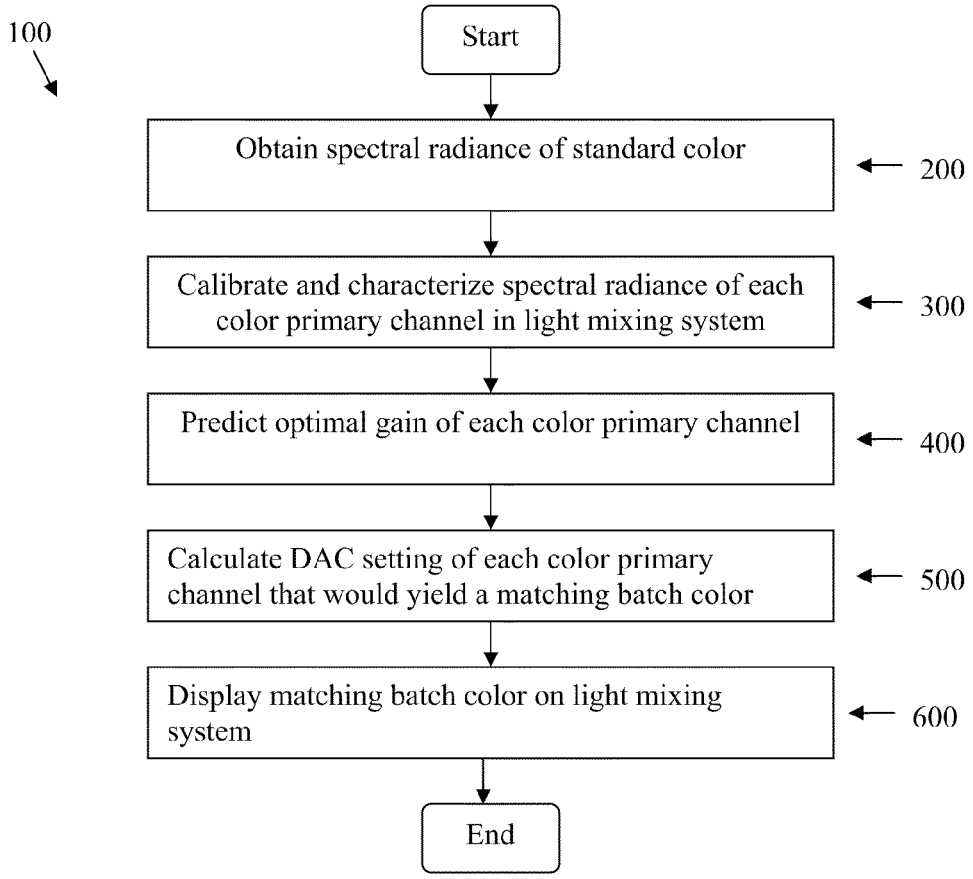
FIG. 2 is a flowchart representation of a color management method according to an embodiment of the present invention.

FIG. 2 is a flowchart that schematically depicts inventive color management method 100. In step 200, a standard color is provided as a target for color matching, and its spectral radiance is determined by a suitable means. In step 300, light mixing system 10 is calibrated so as to profile the spectral radiance of each color primary channel. In step 400, a iterative best-fit method, or other suitable method, is used to predict the optimal gain of each color primary channel, which would create a batch color matching a given standard color. In step 500, the DAC setting of each color primary is calculated that would yield the matching batch color upon mixing of color primaries. In step 600, the batch color is displayed on light mixing system 10. These steps are further described below.

A standard color can be provided in step 200 by at least three means. In a first means, the spectral reflectance factor of a standard color is retrieved from a data file in CPU 20, and is multiplied by the spectral radiance of an illuminating light. The illuminating light may be equipped in a light booth and its spectral radiance may be measured by spectroradiometer 18. In a second means, a physical color standard is illuminated by white light emitted from light mixing system 10, and its spectral radiance is measured by spectroradiometer 18. In a third means, a standard color is synthesized by mixing colored light emitted from additive light mixing system 10, and its spectral radiance is measured by spectroradiometer 18. Step 200 can be performed at a later time, e.g., after the calibration step 300.

Figure 3:
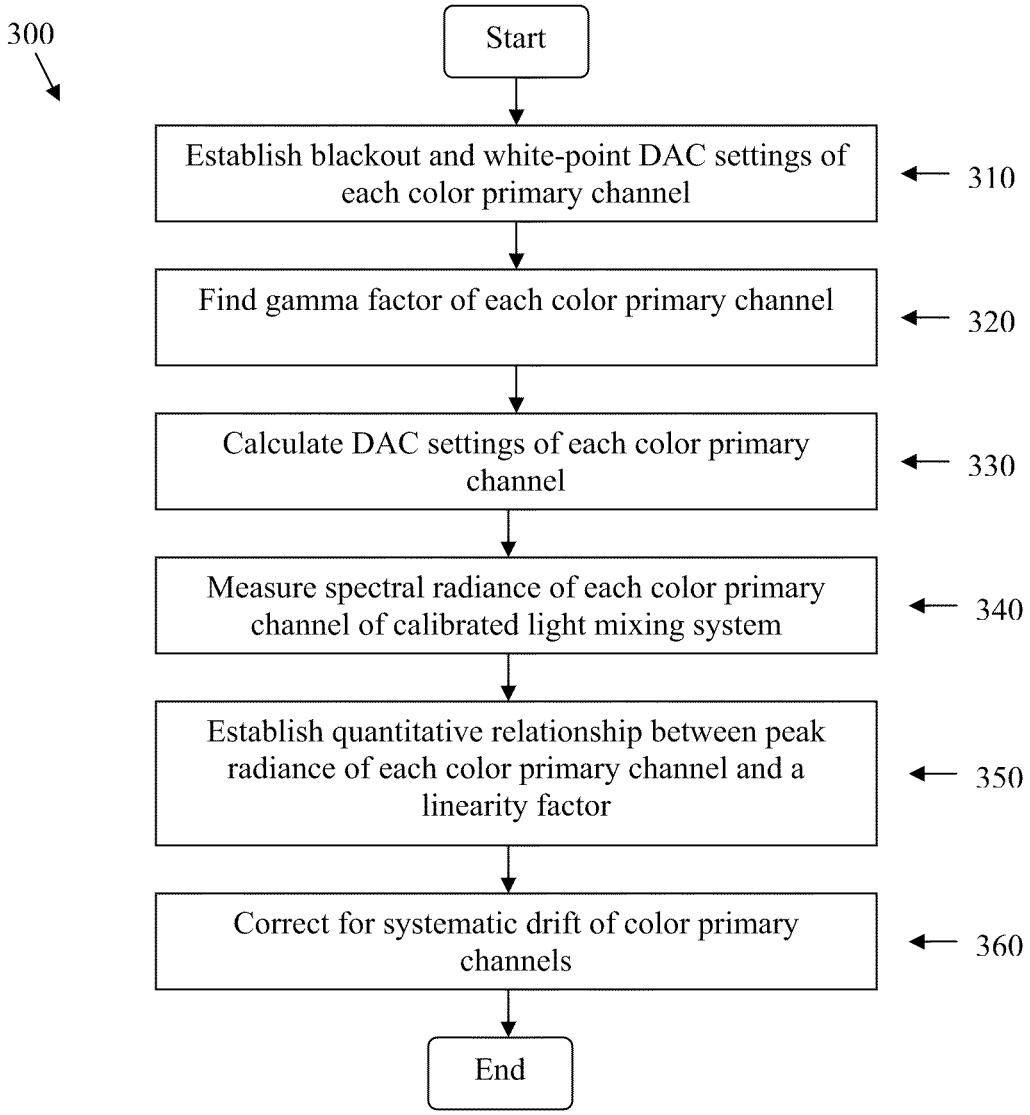
FIG. 3 is a flowchart representation of a method of calibrating a light mixing system.

Step 300 concerns the calibration and characterization of light mixing system 10 in a series of steps 310-360, shown in FIG. 3, which are designed to ascertain several mathematical parameters and DAC settings associated with each color primary channel. It is preferred that a mathematical expression for the DAC settings is pre-selected so that the relevant parameters are identified. In a preferred embodiment, a non-linear exponential equation (Eq. 1) is selected as a mathematical expression that can adequately represent the DAC settings. Other non-linear equations, such as polynomials, parabolic, elliptical, etc., can also be selected and the present invention is not limited to any particular non-linear expression.

$$DAC=LOW+LEN*LIN^{GAMMA} \quad \text{(Eq. 1)}$$

The LOW parameter represents the lowest DAC setting for each primary channel to produce light. In other words, LOW represents the DAC setting that each primary channel will turn on. LOW is also the offset of the non-linear Eq. 1.

The WHITE parameter is the DAC level of each primary channel, where a combination of all WHITE values for all primary channels would produce a standard white color. There can be a number of standard white colors known in the art.

The LEN parameter represents the length between the LOW parameter and the WHITE parameter for an individual primary channel. In other words, LEN=WHITE−LOW. As shown in FIG. 3, in step 310, the LOW, WHITE and LEN variables for each primary channel are determined.

The LIN parameter is an infinitely variable and is a real number ranging from 0.0 to 1.0 for a place on a linear achromatic intensity scale. It serves as the base to be raised to the power of GAMMA (γ). In exemplary Table 1 below, LIN is defined by the present inventors to have 9 levels from 0 to 8. LIN can have any number of levels and the present invention is not limited to any particular number of LIN levels. LIN level zero is the "black" point where DAC is 0.0. Since there are 8 non-black levels, there are 7 intervals between these levels and the LIN values are then incremented at 1/7 between adjacent levels, as shown. At the highest LIN level 8, the DAC value is at the white point for that primary channel. As shown in Table 1, the DAC value at LIN level 8 is the same as the DAC value at WHITE. In a preferred embodiment of the present invention, the LIN values are chosen to be on a linear scale. Alternatively, the linear LIN values can be spaced at uneven increments from adjacent values, e.g., 1/13, 4/13, 5/13, etc.

Table 1 below lists values for these mathematical parameters and DAC settings for an exemplary calibration of light mixing system 10 comprising six color primary channels, i.e., red, yellow, green, cyan, blue, and indigo. The purpose of this exemplary calibration is to determine the GAMMA values for each channel to be used in Eq. 1.

TABLE 1

DAC Settings for a Calibrated Display

| Color Primary | | | | | DAC Settings Level | | | | | | | | |
|---|---|---|---|---|---|---|---|---|---|---|---|---|---|
| | | | | | 0 | 1 | 2 | 3 | 4 | 5 | 6 | 7 | 8 |
| | | | | | LIN | | | | | | | | |
| Channel | LOW | WHITE | LEN | γ | 0 | 0 | 1/7 | 2/7 | 3/7 | 4/7 | 5/7 | 6/7 | 1 |
| Red | 5.5 | 106 | 100.5 | 2.5 | 0 | 5.5 | 6.5 | 10.0 | 17.5 | 30.5 | 49.0 | 74.0 | 106.0 |
| Yellow | 5.5 | 255 | 249.5 | 3.0 | 0 | 5.5 | 6.0 | 11.5 | 25.0 | 52.0 | 96.5 | 162.5 | 255.0 |
| Green | 5.5 | 225 | 219.5 | 3.0 | 0 | 5.5 | 6.0 | 10.5 | 23.0 | 46.5 | 85.5 | 143.5 | 225.0 |
| Cyan | 5.5 | 140 | 139.5 | 2.3 | 0 | 5.5 | 7.0 | 13.0 | 24.5 | 42.5 | 67.5 | 100.0 | 140.0 |
| Blue | 6.5 | 45 | 48.5 | 1.9 | 0 | 6.5 | 7.5 | 10.0 | 14.0 | 20.0 | 27.0 | 35.0 | 45.0 |
| Indigo | 5.5 | 39 | 33.5 | 1.9 | 0 | 5.5 | 6.5 | 8.5 | 12.0 | 17.0 | 23.0 | 30.5 | 39.0 |

As stated above, the LIN parameter is infinitely variable and has a fractional value that can vary from 0 to 1, for a place on a linear achromatic intensity scale. Achromatic as used herein means that there is no detectable color in the light that can be perceived by the human eye. In other words, achromatic comprises black, white and various shades of grey contained therebetween. This linear achromatic scale may be divided into a number of levels, e.g., nine levels from 0 to 8 where at level 0 a channel is entirely off (black) and where at level 8 a channel is at its white-point DAC. The different levels (or grey levels) on the white-point radiance scale represent an increase in LIN value result in an increase in radiance output of the display with chromatic neutrality. As used herein the term "white point" is the resulting color perceived by the human eye in response to a spectral mixture of all constituent colors. See U.S. Pat. Appl. Pub. No. 2005-0047135 A1, which is incorporated herein by reference in its entirety.

In this calibration, the DAC values for six primary channels are chosen such that the spectral mixture of all constituent colors for each LIN level is achromatic or chromatically neutral. Preferably, the DAC values for the primary channels are chosen at LIN level 1 so that the spectral mixture of all constituent colors is an achromatic grey of 1/7 of the white-point. The DAC values for the primary channels are chosen at LIN level 2 so that the spectral mixture of all constituent colors is an achromatic grey of 2/7 of the white-point. The DAC values for the primary channels are chosen at LIN level 3 so that the spectral mixture of all constituent colors is an achromatic grey of 3/7 of the white-point, and so on.

Once the DAC values in the calibration are set, the GAMMA values for each primary channel can be determined, as shown by step 320 of FIG. 3. The GAMMA parameter is a non-linearity exponent which together with LIN, LOW, and LEN may be used to calculate a DAC value at a particular level as provided in equation (1). The GAMMA of each channel is determined by a trial and error or iterative method. First, GAMMA is set to an estimated value, for example 2.0, for each channel. Second, the DAC values that would pertain to each channel at each LIN level are calculated using equation (1) with the estimated GAMMA value and the actual LIN, LOW, and LEN values. Third, light mixing system 10 is used to display a so-called grey level wherein all color primary channels are set to the same lower level, e.g., level 7—about 85.7% or 6/7 of the white-point. Ideally, light mixing system 10 should display a light that is about 85.7% or 6/7 of the white-point. However, if some slight chromaticity is introduced at the grey level then the GAMMA of the color channel generating the chromaticity is reset higher and the exercise iterates until all levels are chromatically neutral. When all grey levels display chromatic neutrality or achromatically, the GAMMA parameters are correct.

Equation (2) is the inverse of equation (1), and it allows one to determine LIN from a known DAC setting, when LOW, LEN and GAMMA are known from the calibration discussed above:

$$LIN = \left(\left(\frac{DAC - \mathrm{LOW}}{LEN}\right)^{\frac{1}{GAMMA}}\right. \quad \text{(Eq. 2)}$$

Figure 4B:
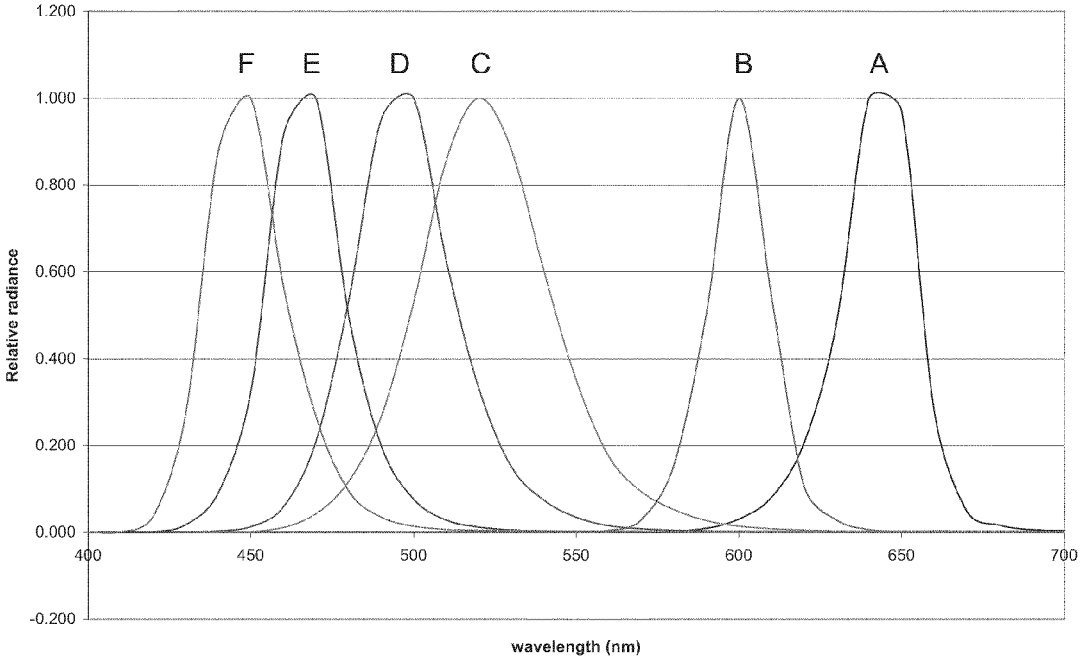
FIG. 4B is a graph representing the data of FIG. 4A.

In step 330, once light mixing system 10 has been calibrated, one calculates the DAC setting of each color primary channel at each LIN using equation (1). Subsequently, in step 340, one can use spectroradiometer 18 to measure the spectral radiance factors for each color primary channel at each LIN using the calculated DAC settings. FIG. 4A shows a table relating the spectral radiance of each color primary channel of a calibrated light mixing system 10 at LIN 1.0 or the white-point. FIG. 4B depicts normalized spectral radiance curves A-F at LIN 1.0 or the white-point for color primary channels red, amber, green, cyan, blue, and indigo, respectively. The curves are normalized to 1.0.

In accordance with another aspect of the present invention, a polynomial best-fit equation is employed to establish a quantitative relationship between the peak radiance of each primary channel and the LIN factor. To a large extent, the radiance values at all wavelengths are proportional to the value at the peak wavelength. Accordingly, one may characterize the entire spectral bandwidth of a color primary channel by the radiance of the peak wavelength ("RAD"). Equation (3) provides a quantitative relationship between the LIN and RAD values of a given color primary channel:

$$\mathrm{LIN}=a_0+a_1\mathrm{RAD}+a_2\mathrm{RAD}^2+a_3\mathrm{RAD}^3 \quad (3)$$

In step 350, coefficients $a_i$, where $i \in \{0, 1, 2, 3\}$ may be determined by a computerized calibration process wherein the peak radiance RAD of each color primary channel is measured at each LIN level from 1 (white-point) to zero. More particularly, a computer program may obtain coefficients of the third-degree polynomial of equation (3) using a least-square best fit method. By way of example, this procedure can yield the following coefficients for red and amber color primary channels: red primary channel ($a_0$: 0.2587, $a_1$: 0.1279, $a_2$: −0.0104, $a_3$: 0.000479) and amber color primary channel ($a_0$: 0.2562, $a_1$: 0.1989, $a_2$: −0.0362, $a_3$: 0.003839). While a polynomial equation is used to establish a relationship between LIN and RAD, it is understood that other non-linear equations can be used to express this relationship, and the present invention is not limited to any particular equation. Additionally, the WHITE parameter discussed above can be set up by setting the radiance or RAD of all primary channels to the LIN level 8 values.

In according with another aspect of the present invention, if there is systematic drift of an individual color primary channel, an optional optical feedback correction of its LIN and DAC values may be made in step 360 by the following procedure. First the channel's RAD value is measured with spectroradiometer 18. Subsequently, the measured RAD value is substituted into equation (3) to obtain an optical feedback value of LIN ("$LIN_{OF}$") that can be compared to the established standard LIN ("$LIN_{GS}$"). By knowing $LIN_{OF}$ and $LIN_{GS}$, a corrected $LIN_C$ value may be obtained by equation (4):

$$LIN_C = LIN_{GS} + (LIN_{GS} - LIN_{OF}) \quad (4)$$

The calculated $LIN_C$ value may be substituted into equation (1) to obtain a corrected DAC value:

$$DAC_C = LOW + LEN * LIN_C^{GAMMA} \quad (5)$$

The corrected DAC value, $DAC_C$, may then be displayed on light mixing system 10 in lieu of the regulation DAC value. This procedure may be followed for each channel that needs to be corrected.

Innovatively, in the optical feedback procedure of step 360, LIN, which is a linear function is used instead of a non-linear radiance function, i.e., RAD or DAC, in order that an additive correction may be applied in equation (4). Conventionally, the practice is to utilize the luminance of the radiance, a weighted radiance function, as the parameter for correction. However, weighting the radiance function does not linearize it and the parameter remains non-linear, even though a linear correction is usually thereafter applied. In step 360, employing the linear function LIN, correcting it and then using the corrected LIN to calculate the non-linear DAC with Eq. 1 apply an additive (or linear) correction to an additive function, thus enhancing the accuracy of the correction.

In step 400, after light mixing system 10 has been calibrated and characterized, a mathematical algorithm may be used to calculate the optimal gain of each color primary channel, which would create a batch color matching a given standard color. The gain is a scalar quantity, or a real number between 0 and 1, that is used as a multiplier on the white-point radiance of each color primary channel. Once optimal gain values are known, CPU 20 can calculate the DAC value for each color primary channel in step 500, and then display the resultant batch color on light mixing system 10. Two mathematical algorithms, which may be used in step 400, are a so-called iterative best-fit method 410 and a matrix method 450, respectively shown in FIGS. 5A-5B and FIG. 6. Method 410 is applicable to a situation where the radiant outputs of the color primary channels are non-linearly related to the input DAC values (non-linear device) as well as to the situation where they are linearly related (linear devices). Method 450 is most useful when the device is linear with input.

Because the radiant outputs of the color primary channels can be non-linearly proportioned to the input DAC values, it can be cumbersome to use conventional methods to determine DAC values that would create a batch color matching a given standard color. For instance, one cannot easily solve simultaneous linear equations for determining DAC values because the equations are not linear. Traditionally, one could use a numerical method such as the Newton-Raphson iterative method. However, the Newton-Raphson method would require that the first derivative of equation (3) be known. But equation (3) is itself a least-squares best fit and may not even pass through the nodes of its own derivation. Thus, although the first derivative of equation (3) is calculable it is likely to be more in error than equation (3) itself. Furthermore, the Newton-Raphson method may not converge to the roots of the simultaneous equations. The Newton-Raphson method may determine a local minimum or actually diverge. Accordingly, iterative best-fit method 410 and matrix method 450 avoid the use of a first-derivative. Moreover, method 450 are also advantageous because they avoid the use of labor-intensive methodologies, such as those disclosed in the Fryc publications, cited above, wherein colors are matched via feedback control of individual LEDs using spectroradiometer readings.

Figure 5A:
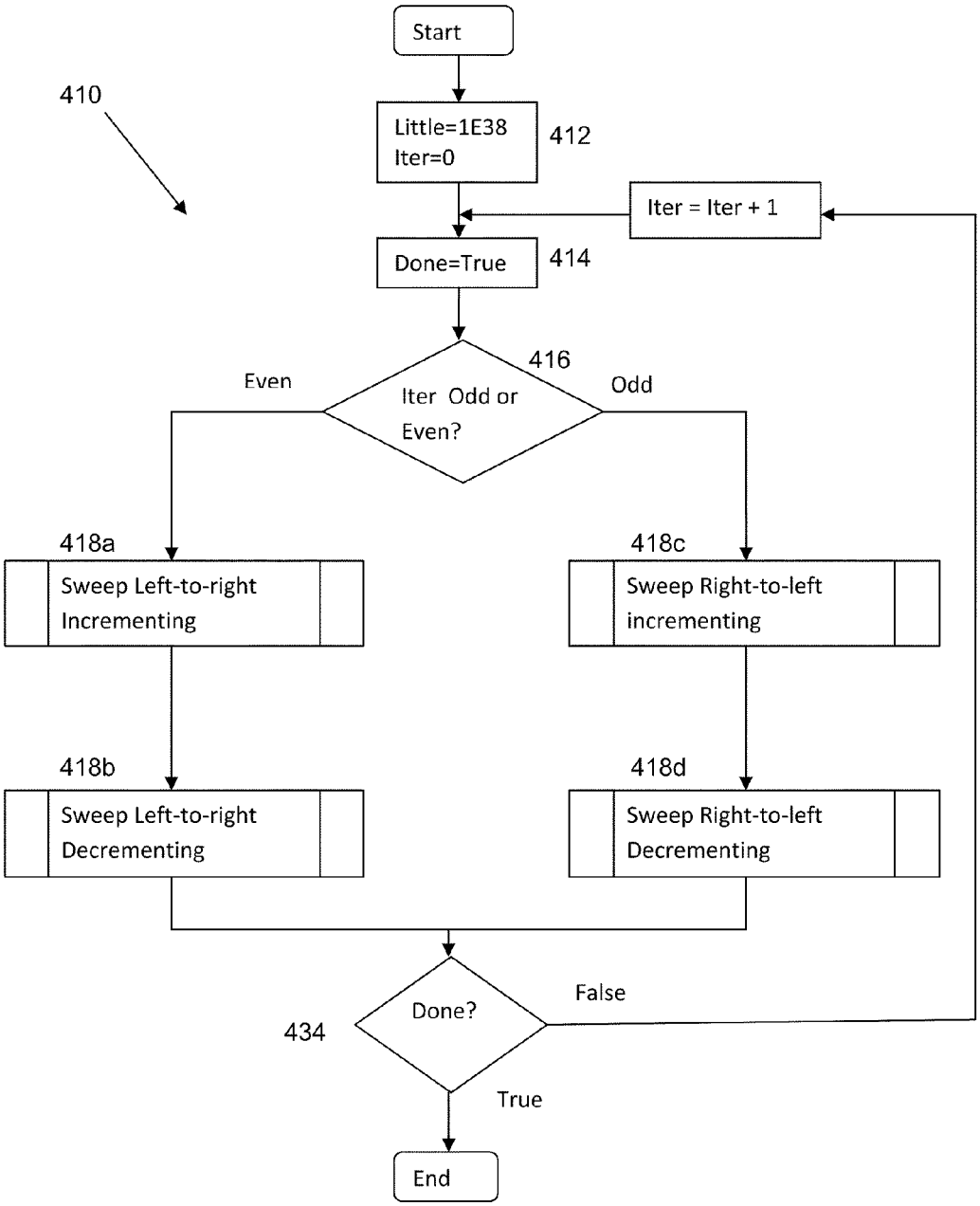
FIGS. 5A and 5B are flowchart representations of a method of predicting the optimal gain of each color primary channel according to an embodiment of the present invention.
Figure 5B:
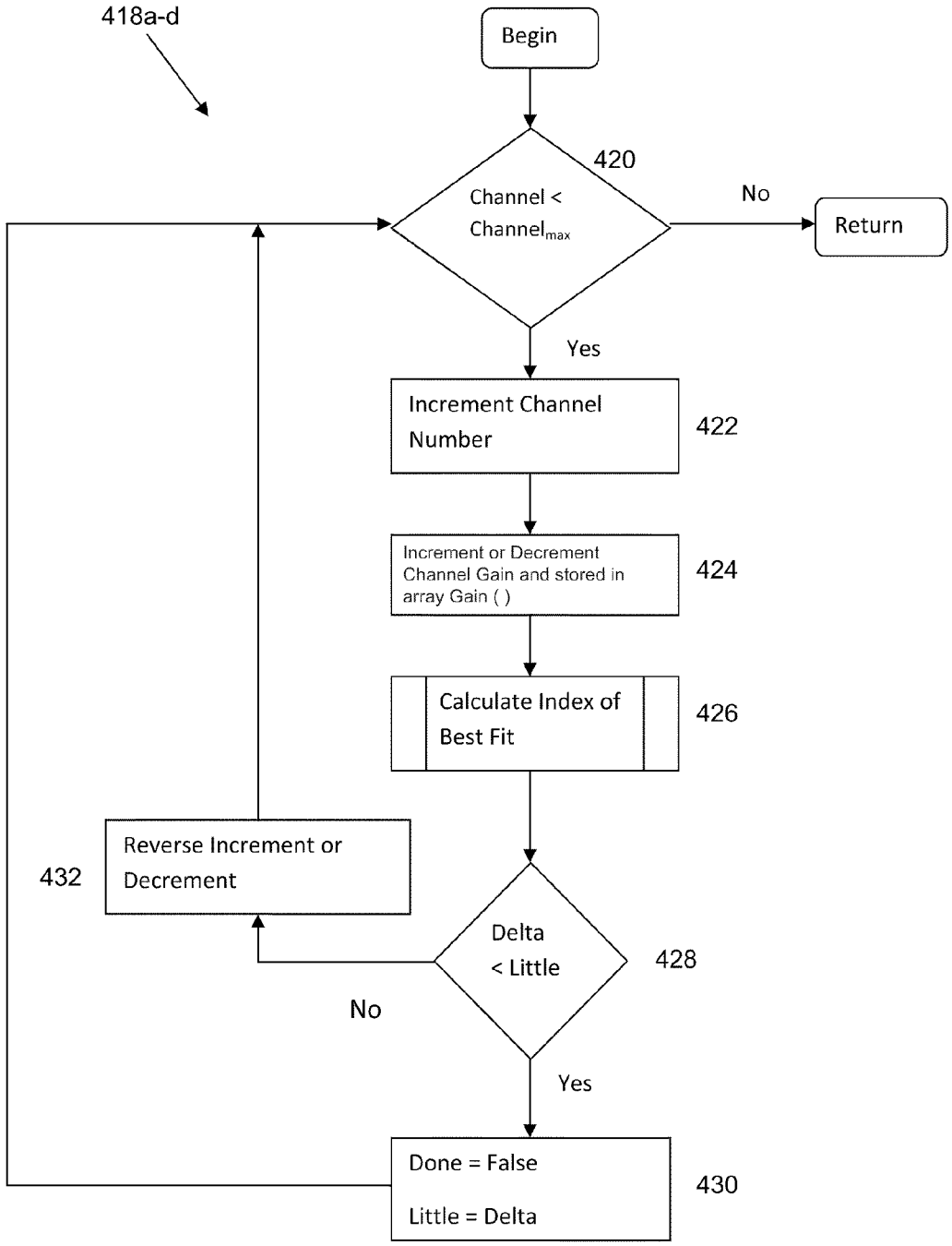

FIGS. 5A-5B show an exemplary iterative best-fit method 410 executed by CPU 20 using a suitable software program written in Visual Basic or another appropriate computer language. Iterative best-fit method 410 comprises an operational sequence of steps, wherein CPU 20 adjusts the gain of each color primary channel incrementally, decrementally and serially. After each adjustment in gain, CPU 20 determines whether there has been an improvement in an index of best fit. For example, and without limitation, the index of best fit can be the root mean square difference ("RMSD") between the radiances of a standard color spectrum and a batch color spectrum. Eventually, a stable state condition is reached where CPU 20 can pass through all the color primary channels and fail to improve the index of best fit. The gain values for such a stable state condition are used to ascertain a batch color spectrum.

In step 412, initial parameters of iterative best-fit method 410 are set. For instance, a variable labeled "Little," representing the index of best fit, is initially set to a value that is reasonably larger than any index of best fit value that could be encountered during the course of method 410, such as the largest number that can be stored in CPU 20 (e.g., $10^{38}$). Subsequently, during the course of method 410, the Little variable will hold the most favorable as yet found index of best fit (e.g., the smallest as yet found RMSD value).

Another variable labeled "Iter," representing the number of iterations, is initially set to zero in step 412. An iteration is a cycle comprising two sweeps of the color primary channels in the same direction, such as an incremental sweep followed by a decremental sweep. A sweep is a simulated process wherein one serially adjusts the gain of each color primary channel, i.e., by increasing the gain (an incremental sweep) or decreasing the gain (a decremental sweep). Sweeps may be made either from left-to-right, i.e. counting up from the first channel to the highest numbered channel (stored as a constant in "$Channel_{max}$"), or from right-to-left, i.e. counting down from $Channel_{max}$ to the first channel.

Another variable labeled "Done" is a Boolean flag that is set to True, in step 414, before the start of each iteration. Accordingly, if no improvement in the index of best fit is found during an iteration then the end of iterative best-fit method 410 is signaled. Also before the start of each iteration, the value of Iter is used to alternate between left-to-right and right-to-left sweep modes at step 416. For instance, if the value of Iter is even then a left-to-right sweep is signaled, but if the value of Iter is odd then a right-to-left sweep is signaled. Alternating directions adds symmetry to iterative best-fit method 410 so that the first channel is not always considered at onset.

In steps 418*a-d*, CPU 20 conducts iterative sweeps of the color primary channels from left-to-right (i.e., sweeps 418*a*, 418*b*) and from right-to-left (i.e., sweeps 418*c*, 418*d*). As shown in FIG. 5A, incremental sweeps 418*a*, 418*c* are conducted before decremental sweeps 418*b*, 418*d* during a given iteration, but one of ordinary skill in the art would readily understand that the order may be reversed so that decremental sweeps 418*b*, 418*d* may occur before incremental sweeps 418*a*, 418*c*.

FIG. 5B details steps during a given sweep 418*a-d*. In step 420, CPU 20 checks if a sweep should come to an end by checking if a variable labeled "Channel," which holds the current channel number, has reached an endpoint, i.e., $Channel_{max}$ (for left-to-right sweeps 418*a*, 418*b*) or the first channel (for right-to-left sweeps 418*c*, 418*d*). If the endpoint has not been reached, then in step 422, the variable Channel is increased by 1 (for left-to-right sweeps 418*a*, 418*b*) or decreased by 1 (for left-to-right sweeps 418*c*, 418*d*).

At the beginning of iterative best-fit method 410, the gain of each color primary channel is set to zero and stored in an array variable known as Gain( ) which is a numerical value that is used to adjust the peak radiance (RAD) for each primary channel. It contains as many elements as channels. Accordingly, the initial gains represent a blackout condition wherein each channel is off. However, subsequently, during step 424, CPU 20 increases or decreases the gain of a given color primary channel by an arbitrarily small amount, e.g., 0.001 (milliWatt/Sr/cm$^2$/nm). During an incremental sweep 418*a*, 418*c*, a given channel's gain is increased, and during a decremental sweep 418*b*, 418*d*, a given channel's gain is decreased.

In step 426, CPU 20 determines the spectral radiance of a batch color spectrum that would be generated using the gain values from step 424, and then it calculates the index of best fit between the batch color spectrum and the standard color spectrum. More particularly, the gain value for each color primary channel is multiplied on the calibrated spectral radiance values for that color primary channel, e.g., calibrated spectral radiance values from the table in FIG. 4A, to yield the spectral radiance for that color primary channel. The spectral radiance values of all color primary channels are added together at each wavelength to obtain the simulated spectral radiance of light mixing system 10, i.e., the batch color spectrum.

Once the batch spectrum is found, one can calculate the index of best fit. If the index of best fit is the RMSD, its value may be calculated using equation (6), where $x_{1,i}$ represents data points for the batch color spectrum, $x_{2,i}$ represents data points for the standard color spectrum, and n represents the number of data points (e.g., the number of wavelengths being considered) for the standard and batch color spectra:

$$RMSD = \sqrt{\frac{\sum_{i=1}^{n}(x_{1,i} - x_{2,i})^2}{n}} \tag{6}$$

The calculated value of RMSD, or another index of best fit, is stored in a variable labeled "Delta." For instance, instead of calculating the root mean square difference, one may simply calculate the square difference between the batch color spectrum and the standard color spectrum, $$\text{i.e., } \sum_{i=1}^{n}(x_{1,i} - x_{2,i})^2.$$

Alternatively, one can use the best fit of tristimulus values as opposed to spectral radiance values to calculate the index of best fit. For example, using this method, one can identify a number of "batch" spectral radiance curves that yield the least colorimetric difference in comparison to the standard color for a given colorimetric tolerance. One can then select the best batch spectral radiance curve based on a certain parameter, e.g., least color inconstant index. Advantageously, in the case of limited number of color primary channels such as the present 6 channels example (particularly with missing radiant energy in between color primary channels), a two-stage method utilizing the iterative best fit method and follow by best fit tristimulus method or best fit minimum RMSD method can yield a batch color that more accurately matches a standard color.

In step 428, CPU 20 evaluates whether the best fit value stored in Delta is an improvement over the best fit value of stored in Little. For example, when RMSD is the index of best fit, an assessment is made to determine if Delta is less than Little. If the value of Delta is an improvement, then in step 430 the gain from step 424 is retained, the value of Delta is assigned to the Little variable, and the sweep process passes to the next channel. If the value of Delta is not an improvement, then in step 432 the increment or decrement from step 424 is reversed to reset the gain to its former level before passing to the next channel.

Returning to FIG. 5A, in step 434, after the completion of each iteration, CPU 20 determines whether or not iterative best-fit method 410 should terminate. If CPU 20 can incrementally and decrementally pass through all the color primary channels in an iteration and fail to improve the index of best fit, then iterative best-fit method 410 terminates. The optimal gain values for such a stable state condition are stored in Gain( ).

Figure 7:
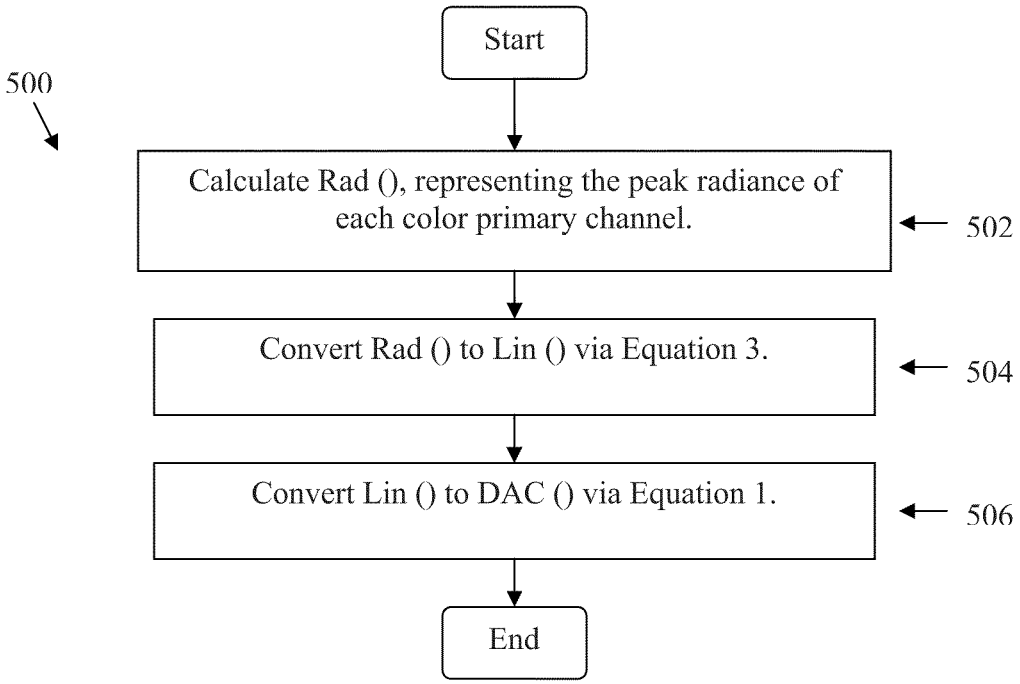
FIG. 7 is a flowchart representation of a method of calculating the DAC setting of each color primary channel.

Once the gains of the color primary channels are found in step 400, they can be used to determine the color representation output of the batch color. More particularly, as shown in FIG. 7, in step 500, a series of calculations are used to determine the DAC settings for each color primary channel, which would display the batch color on light mixing system 10. First, in step 502, the gain of each color primary channel is multiplied into the peak radiance of each calibrated color primary channel (as noted in the table of FIG. 4A), thereby yielding an array RAD( ) that stores the RAD value of each color primary channel. Subsequently, in step 504, the RAD value of each color primary channel is used in equation (3) to obtain the LIN value for each color primary channel, which is stored in an array LIN( ). Next, in step 506, the LIN value for each color primary channel is used in equation (1) to obtain the DAC value for each color primary channel, which is stored in an array DAC( ).

Figure 6:
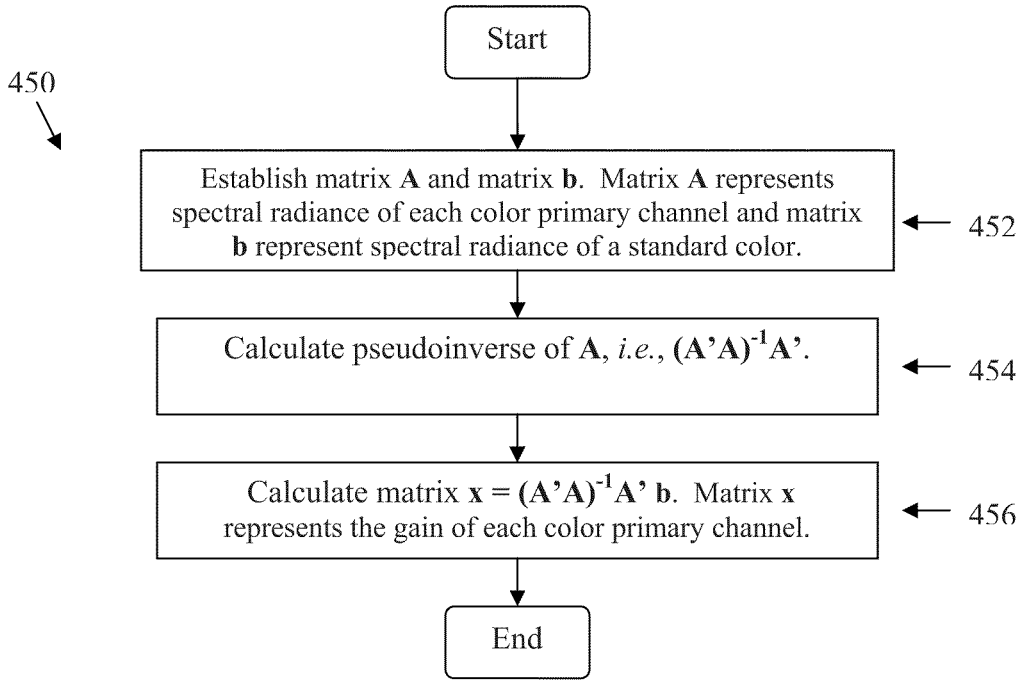
FIG. 6 is a flowchart representation of a method of predicting the optimal gain of each color primary channel according to another embodiment of the present invention.

In an alternative embodiment, instead of iterative best-fit method 410, matrix method 450 may be used to predict the optimal gain values of each color primary channel, which would create a batch color that matches a standard color. FIG. 6 shows the operational sequence of steps used during matrix method 450. The objective of matrix method 450 is to utilize matrix algebra with equation (7), and thereby arrive at equation (8) that solves for the unknown gain values of the batch color spectrum represented in matrix x:

$$Ax=b \tag{7}$$

$$x=(A'A)^{-1}A'b \tag{8}$$

Matrix x is an n×1 matrix, where n is the number of color primary channels being considered. The properties of matrices A, A', and b are explained in turn below.

In step 452, the spectral radiance of each color primary channel at LIN=1 or the white-point is formed into a matrix A having m rows and n columns, where m rows represent the number of wavelength intervals between 360 and 780 nm (e.g., 43 rows representing 10 nm intervals) and n columns represent the number of color primary channels. For example the data in the table from FIG. 4A may be formed into matrix A. Similarly, the spectral radiance of the standard color spectrum is formed into matrix b, which is an m×1 matrix.

Because Matrix A is not a square matrix, it has no inverse. Accordingly, in step 454, CPU 20 determines a pseduoinverse of A, i.e., $(A'A)^{-1}A'$. The pseduoinverse is a generalized inverse that is found by (i) multiplying the transpose of A, or A', with A itself, (ii) inverting the resultant matrix, and (iii) multiplying the inverse matrix into A'.

In step 456, pseudoinverse $(A'A)^{-1}A'$ is multiplied into the matrix b, which contains the standard color spectrum. Accordingly, as noted in equation (8), the product is matrix x, which relates the gains of the color primary channels. Because pseudoinverse $(A'A)^{-1}A'$ is a parameter of the color primary channels, it may be calculated once and used with any given standard color spectrum formed into matrix b.

Figure 8:
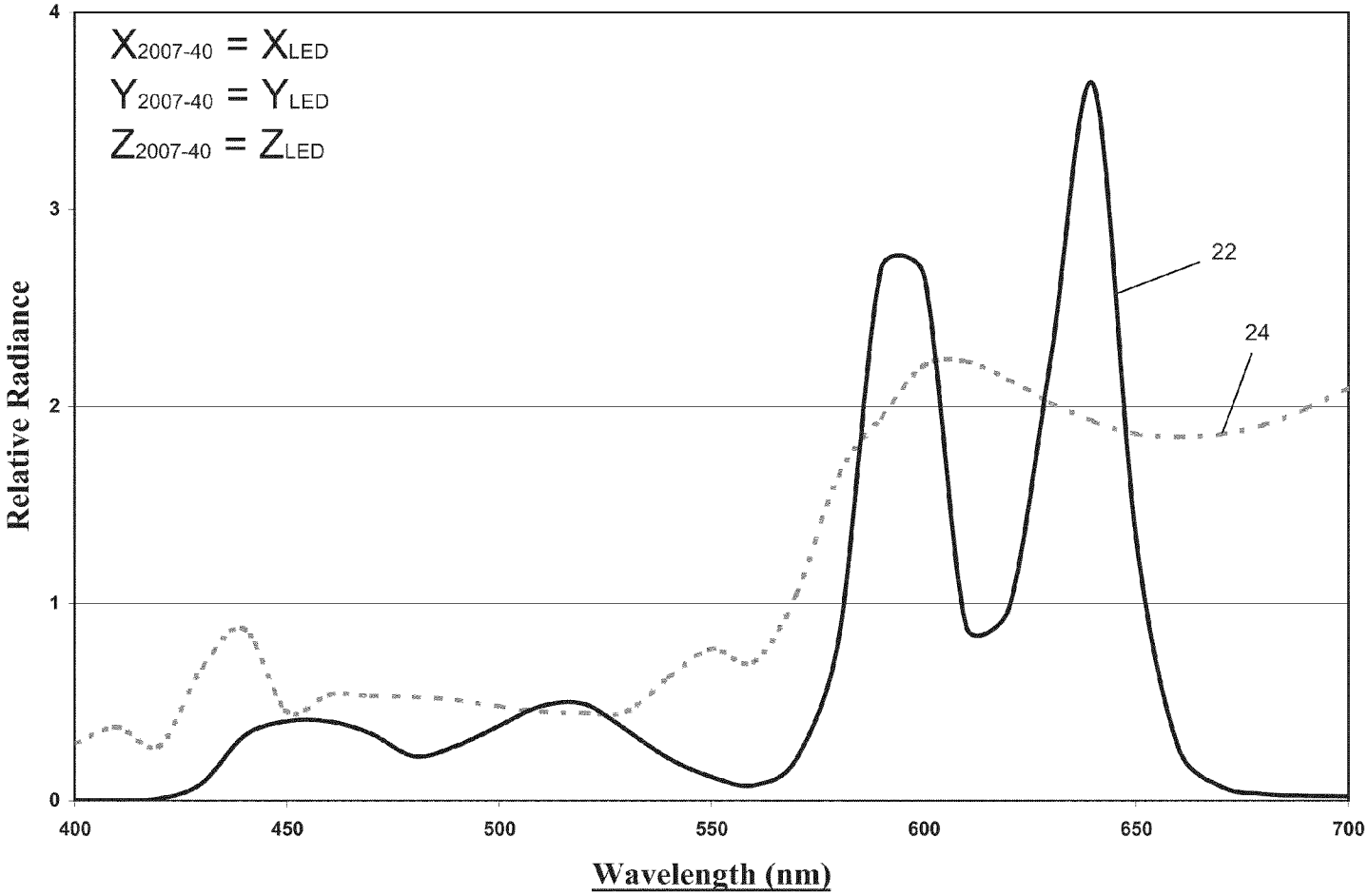
FIG. 8 is a graph representing the spectral power distribution curves of a standard color and one batch color when six color primaries are used.

In step 600, shown in FIG. 2, controller 16 uses the DAC values from step 506 to set the level of each color primary channel, and light mixing system 10 displays a batch color that matches a standard color. FIG. 8 displays the result of using color management method 100, employing iterative best-fit method 410, in conjunction with the "best fit tristimulus method," which is a non-spectral technique, to match a standard color spectrum having a spectral power distribution identified as "2007-40". In other words, using the "best-fit tristimulus values" method is taking the calculated result from either the "iterative best-fit" method 410 or the "matrix" method 450 and optimize this result so that color difference between this spectral radiance spectrum and the corresponding standard is minimal. As shown in FIG. 8, the color differences in all three coordinates are substantially zero.

Preferably the CIE DE2000 color difference equation for this color difference calculation (See ASTM D2244 Standard Practice for Calculation of Color Tolerances and Color Differences from Instrumentally Measured Color Coordinates) is used. This technique of "best-fit tristimulus values" method is used in a number of color matching applications in color prescription (See Basic Equations Used in Computer Color Matching, II. Tristimulus Match, Two-Constant Theory, by Eugene Allen, Journal of the Optical Society of America, Vol. 64, Issue 7, pp. 991-993 (1974)), which is incorporated by reference in its entirety. When 6 LED color primary channels (i.e., indigo, blue, cyan, green, yellow, and red channels) are utilized, the resultant color spectrum has a spectral power distribution 22 compared to a spectral power distribution of a standard color 24. When sixteen LED color primary channels are utilized in conjunction with the matrix method 450, the resultant color spectrum has a spectral power distribution 26, shown in FIG. 9. Given that curve 26 is substantially similar to the spectral power distribution of standard color 28, i.e., spectral color matching, whereas the corresponding two curves are much more different in FIG. 8 although they have the same CIE tristimulus values (i.e., tristimulus color matching).

It should be noted that, whenever possible, spectral color matching always result in a better match between the batch color and the standard color than tristimulus color matching as any metamerism present is minimized or eliminated. In other words, the performance of the color management method 100, in terms of spectral color matching, increases as the number of suitable color primary channels increases.

Table 2 below shows the spectral color matching performance of inventive color management method 100 utilizing iterative best-fit method 410 and matrix method 450. Each method 410, 450 was used with a total of 1226 standard colors, and thirteen color primary channels were used to display the batch color on light mixing system 10. The synthesized batch colors were measured using spectroradiometer 18. The CIEDE2000 color difference equation was used to evaluate spectral matching between the standard color and the batch color. The CIEDE2000 color difference formula is also described in G. Sharma, W. Wu, and E. Dalai, "The CIEDE2000 Color-Difference Formula: Implementation Notes, Supplementary Test Data, and Mathematical Observations," *Color Res. Appl.* 30: pp. 21-30, February 2005, which is incorporated herein by reference in its entirety.

The CIEDE2000 values were calculated for different lighting conditions (i.e., CIE Illuminants D65, F11, and A as well as a Balanced Illuminant) and a 10 degree standard observer. The CIE Illuminant D65, representing average noon daylight, is a commonly-used standard illuminant and has a correlated color temperature ("CCT") of about 6504 K. The CIE Illuminant F11 (CCT 4000 K) represents TL84, narrow band tri-phosphorous fluorescent light sources. The CIE Illuminant A (CCT 2856 K) represents incandescent light sources such as household tungsten filament lamps. The Balanced Illuminant has a CCT in the range of about 4200 K to about 4600 K and more preferably about 4300 K to about 4500 K, which emulates a balance of lighting conditions between cool (6500 K) and warm (2856 K) color temperatures (herein "Balanced Illuminant"). Such balance is achieved by a using a spectral power distribution that mixes, in the proper ratio, the standard CIE Illuminants D65 and A. Further information on color difference equations and illuminants may be found in commonly owned, co-pending U.S. patent application Ser. No. 12/380,697, which is incorporated herein by reference in its entirety.

TABLE 2

Spectral Color Matching Performance (CIEDE2000 Units)

| Method | Illuminant (10° Standard Observer) | Minimum | Median | Mean | 95% | Maximum |
|---|---|---|---|---|---|---|
| Iterative best-fit Method 410 | CIE Illuminant D65 | 0.3 | 2.5 | 2.6 | 4.8 | 6.4 |
| | Balanced Illuminant | 0.2 | 2.1 | 2.2 | 3.9 | 4.9 |
| | CIE Illuminant F11 | 0.2 | 1.0 | 1.1 | 2.2 | 3.0 |
| | CIE Illuminant A | 0.2 | 2.1 | 2.2 | 4.1 | 4.8 |
| Matrix Method 450 | CIE Illuminant D65 | 0.3 | 2.5 | 2.6 | 4.8 | 6.4 |
| | Balanced Illuminant | 0.2 | 2.1 | 2.2 | 3.9 | 4.9 |
| | CIE Illuminant F11 | 0.2 | 1.0 | 1.1 | 2.2 | 2.9 |

TABLE 2-continued

| Spectral Color Matching Performance (CIEDE2000 Units) | | | | | | |
|---|---|---|---|---|---|---|
| Method | Illuminant (10° Standard Observer) | Minimum | Median | Mean | 95% | Maximum |
| | CIE Illuminant A | 0.2 | 2.1 | 2.3 | 4.1 | 4.8 |

Figure 9:
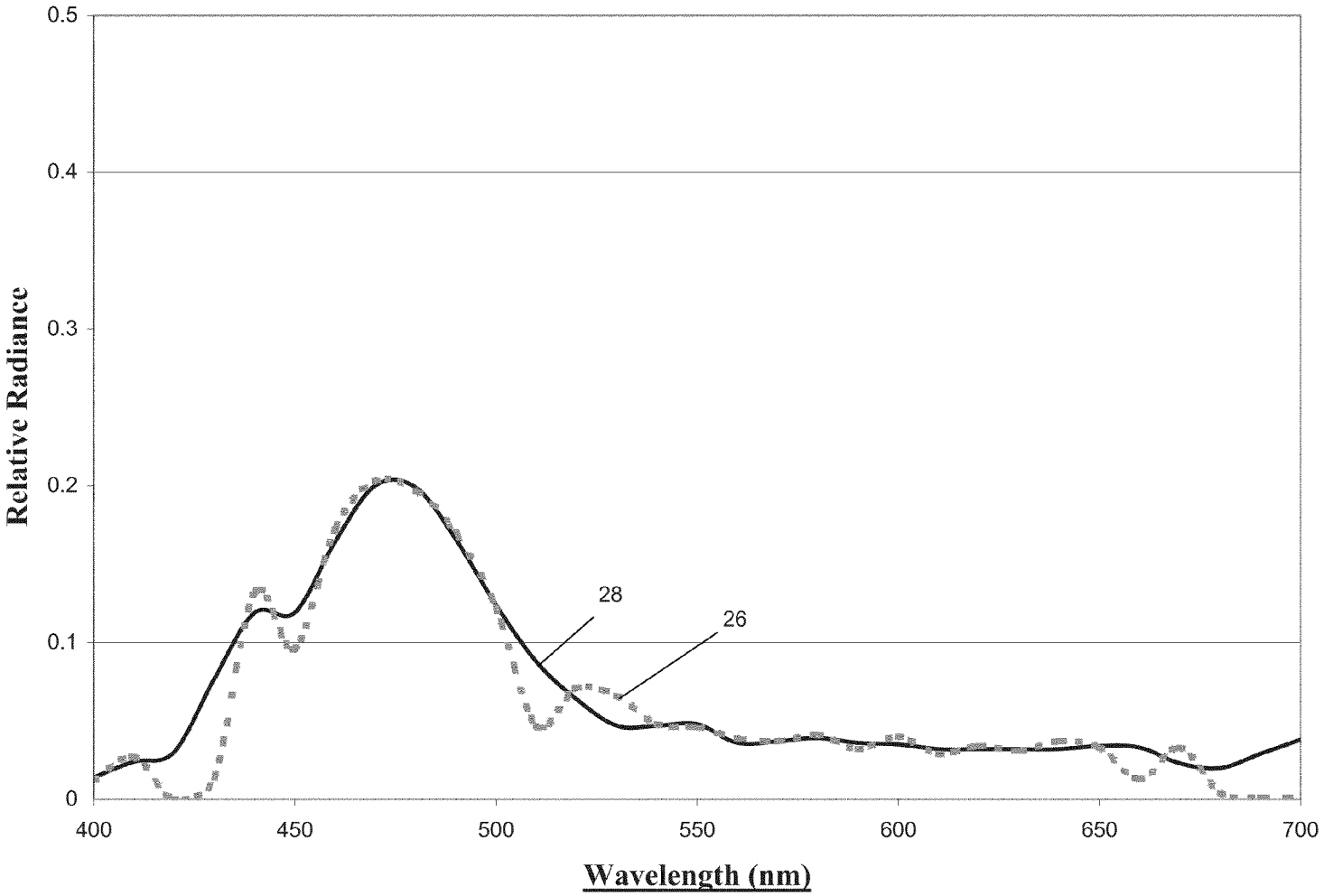
FIG. 9 is a graph representing the spectral power distribution curves of a standard color and one batch color when sixteen color primaries are used.
Figure 10:
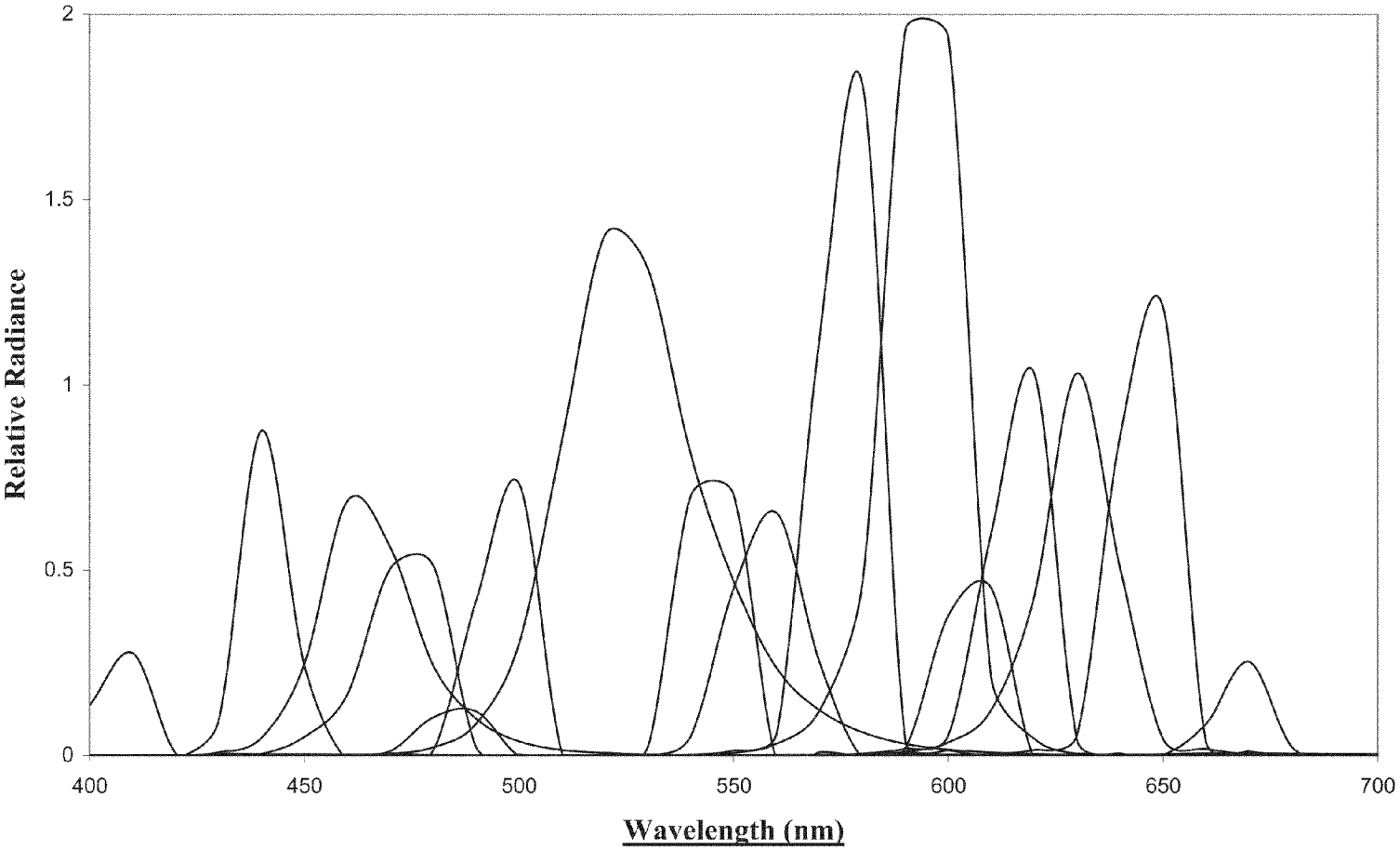
FIG. 10 is a graph showing an exemplary embodiment of the present invention illustrating the sixteen primaries used in the light mixing system.

Table 2 demonstrates there is no significant difference in performance between the matrix method 450 and the iterative best-fit method 410. The minimum, mean, 95%, and maximum CIEDE2000 values are substantially the same. Thus, either iterative best-fit method 410 or matrix method 450 can produce spectrally accurate batch colors. FIG. 9 illustrates the spectral color matching performance for a blue color standard, based on the matrix method 450, which used sixteen color primary channels for color matching. Nonetheless, in terms of calculation efficiency, matrix method 450 may be preferred. FIG. 10 illustrates the peak radiances of a collection of sixteen exemplary primary color channels usable with light mixing system 10.

Methods 410 and 450 are most suited for spectral color matching application employing adequate number of color primary channels and its combined output has adequate continuous radiant energy over the visible wavelength range. In another embodiment of the present invention, these two methods can be used in conjunction with the "best fit tristimulus values" method, discussed above, are most suited for tristimulus color matching application employing limited number of color primary channels and its combined output has inadequate continuous radiant energy over the visible wavelength range. Although it is preferred that the best fit tristimulus values method be used in conjunction with spectral matching when a limited number of primary channels is employed, the best fit tristimulus value method can be used in conjunction with spectral matching employing any number of primary channels.

While various embodiments of the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

The invention claimed is:

1. A method of operating a color mixing apparatus comprising the steps of a. providing a plurality of primary color channels of the color mixing apparatus, wherein the radiant light output of each channel is modulated by a digital-to-analog (DAC) value;

b. selecting a plurality of linear values (LIN) from a black point to a WHITE parameter, wherein the WHITE parameter is the DAC value of each primary channel where a combination of WHITE values for all the primary channel produces a standard white color;

c. selecting a first linear mathematical expression that relates the DAC values to the LIN values;

d. setting the DAC values of each primary color channel of the color mixing apparatus so that the combined outputs of the primary color channels are achromatic for each LIN value; and e. solving the linear equations using a matrix method.

2. The method of claim 1, wherein step (e) comprises the steps of e.1 establishing matrix A to include spectral radiance of each primary color channel, e.2. establishing matrix b to include spectral radiance of a standard color, e.3. establishing matrix x to include the gains for the primary color channels, wherein $Ax=b$, wherein $x=(A'A)^{-1}A'b$, and wherein A is a matrix of $(m\times n)$, where m and n are integers greater than 0, x is a matrix of $(n\times 1)$, A'is the transpose of A, b is a matrix of $(m\times 1)$ and $(A'A)^{-1}A'$ is the pseudoinverse of A.

3. The method of claim 2, wherein n is the number of color primary channels.

4. The method of claim 2, wherein m is the number of wavelength intervals within the visible electromagnetic spectrum.

5. The method of claim 2 wherein m is the number of wavelength intervals between 360 nm and 780 nm.

6. The method of claim 2 further comprising the step of using the gains in matrix x to calibrate the color mixing apparatus.

7. The method of claim 1, wherein the plurality of primary color channels comprise light emitting diodes.

8. The method of claim 1, wherein the plurality of primary color channels comprise at least one of a fluorescent, incandescent and halogen light source.

9. The method of claim 1, wherein the radiant outputs of the plurality of primary color channels are managed by a controller.

* * * * *